US006881137B2

(12) United States Patent
Friel, Sr.

(10) Patent No.: US 6,881,137 B2
(45) **Date of Patent: *Apr. 19, 2005**

(54) MANUAL KNIFE SHARPENER WITH ANGLE CONTROL

(75) Inventor: Daniel D. Friel, Sr., Greenville, DE (US)

(73) Assignee: Edgecraft Corporation, Avondale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/683,799

(22) Filed: Oct. 10, 2003

(65) Prior Publication Data

US 2004/0077299 A1 Apr. 22, 2004

Related U.S. Application Data

(63) Continuation-in-part of application No. 10/023,190, filed on Dec. 18, 2001, now Pat. No. 6,726,551.

(60) Provisional application No. 60/260,980, filed on Jan. 11, 2001.

(51) Int. Cl.[7] ..... B24B 23/00

(52) U.S. Cl. ..... 451/349; 451/45; 451/57; 451/549; 451/193; 451/234; 451/344; 451/411

(58) Field of Search ..... 451/349, 45, 57, 451/549, 193, 234, 241, 267, 545, 361, 344, 411

(56) References Cited

U.S. PATENT DOCUMENTS

| | | | | |
|---|---|---|---|---|
| 884,249 A | * | 4/1908 | Wieber | 451/361 |
| 4,716,689 A | | 1/1988 | Friel | |
| 4,897,965 A | | 2/1990 | Friel | |
| 5,390,431 A | | 2/1995 | Friel | |
| 5,404,679 A | * | 4/1995 | Friel et al. | 451/312 |
| 5,478,272 A | | 12/1995 | Cozzini | |
| 5,582,535 A | | 12/1996 | Friel | |
| 5,620,359 A | | 4/1997 | Harrison et al. | |
| 6,267,652 B1 | | 7/2001 | Friel | |

FOREIGN PATENT DOCUMENTS

GB 1 343 025 9/1974

* cited by examiner

*Primary Examiner*—Hadi Shakeri
*Assistant Examiner*—Alvin J Grant

(57) ABSTRACT

A sharpener for blades comprises a physical structure supporting at least one abrasive surface. A displaceable guiding plate having an integral linear structural feature of the support is disposed toward one side of the abrasive surface. The linear structural feature provides sliding contact with a face of the blade to establish the relative angle of the plane of the edge facet of the blade with the plane of the abrasive surface at the point of mutual contact as the facet is guided into contact with the abrasive surface.

23 Claims, 8 Drawing Sheets

MANUAL KNIFE SHARPENER WITH ANGLE CONTROL

CROSS REFERENCE TO RELATED APPLICATIONS

This application is a continuation-in-part of application Ser. No. 10/023,190, filed Dec. 18, 2001 now U.S. Pat. No. 6,726,551, which is based on provisional application Ser. No. 60/260,980, filed Jan. 11, 2001.

BACKGROUND OF THE INVENTION

A wide variety of manual knife sharpeners have been used for centuries, but most of these have been disappointing because they did not provide a precise means to control the sharpening angle. The importance of angle control to the creation of ultra sharp knife edges is recognized in, for example, U.S. Pat. Nos. 5,390,431 and 4,627,194.

Manual sharpeners have been described by others where control of the sharpening angle is obtained by use of clamping devices or blade carriers in which the blade is mounted in a mechanism and physically restrained so that the facet of the blade edge is restrained to remain parallel to the abrasive sharpening surface as the clamping device or carrier is moved in a predetermined direction relative to the abrasive sharpening surface. A major disadvantage of using such clamping devices or carriers to control sharpening angle is the awkwardness and inconvenience of the devices themselves.

One example of such blade carriers, U.S. Pat. No. 2,652,667 by C. D. Arnold, describes a sharpener where the blade is placed in a knife blade holder which moves in a direction parallel to the surface of the sharpening stone while the blade facet is in contact with the abrasive stone. The blade is wedged into the blade holder that sets the blade at a predetermined angle to the abrasive surface. Another example, is U.S. Pat. No. 3,882,642 by C. S. Sykes which describes a different knife holder that moves in a direction parallel to the surface of the sharpening stone. The blade is held in fixed nonsliding contact with the holder as the holder is moved in a direction parallel to the abrasive surface. As the holder moves the knife edge moves with it in contact with the abrasive surface.

There has been a plethora of manual sharpeners ranging from sharpening stones and manuals steels to more modern sharpeners such as described in U.S. Pat. No. 5,477,753 that provide no means to control accurately the angle between the plane of the edge facet and the abrasive surface at their point of contact.

SUMMARY OF THE INVENTION

This application relates to a sharpener that uses novel techniques to provide convenient yet precise angle control for manual knife sharpeners.

Advantages of manual sharpeners as a class are their simplicity, portability and ease of use. The new and novel guide structure described here preserves these advantages while permitting control of the blade to be totally manual and where its control is entirely free of any clamping device or carrier, yet one is able to maintain a consistent sharpening angle stroke after stroke. This new concept can be implemented in a wide variety of physical configurations while incorporating any of the well-known abrasive surfaces.

The novel sharpener of this invention relies on a precise displaceable physical plate like structure with a linear edge or other linear structural feature against which the face of the blade is manually positioned and manually aligned in sliding contact with that linear feature as the facet of that blade is manually caused to traverse along an abrasive surface. The physical surface of the displaceable linear feature is restrained to move only in a direction nominally perpendicular to the axis of its linear guide. The axis of the displaced linear guide surface will consequently remain parallel to its previous axial alignment. By manually maintaining the face of the blade in full sliding contact and alignment with the linear guide surface and nominally perpendicular to the plane of the guide plate as the facet of the blade edge is moved across or along the abrasive surface, excellent control of the sharpening angle is insured and a sharp edge is created. The grit size and the type of abrasive can be selected to be more or less aggressive depending on the dullness of the edge. By changing the angle between the linear guide surface and the plane of the abrasive surface, the sharpening angle of the blade can be varied to suit the users need. Sharpening of a blade can be conducted in one of more stages of progressively larger sharpening angle and finer grits so as to establish one or more edge facet angles and improve the perfection of the ultimate edge.

The linear guide surface can be located in front of the abrasive as seen by the user, behind the abrasive, or in the middle of the abrasive plane. In the last case, the abrasive would be located in front of and behind the linear guide surface.

THE DRAWINGS

DETAILED DESCRIPTION

Figure 1:
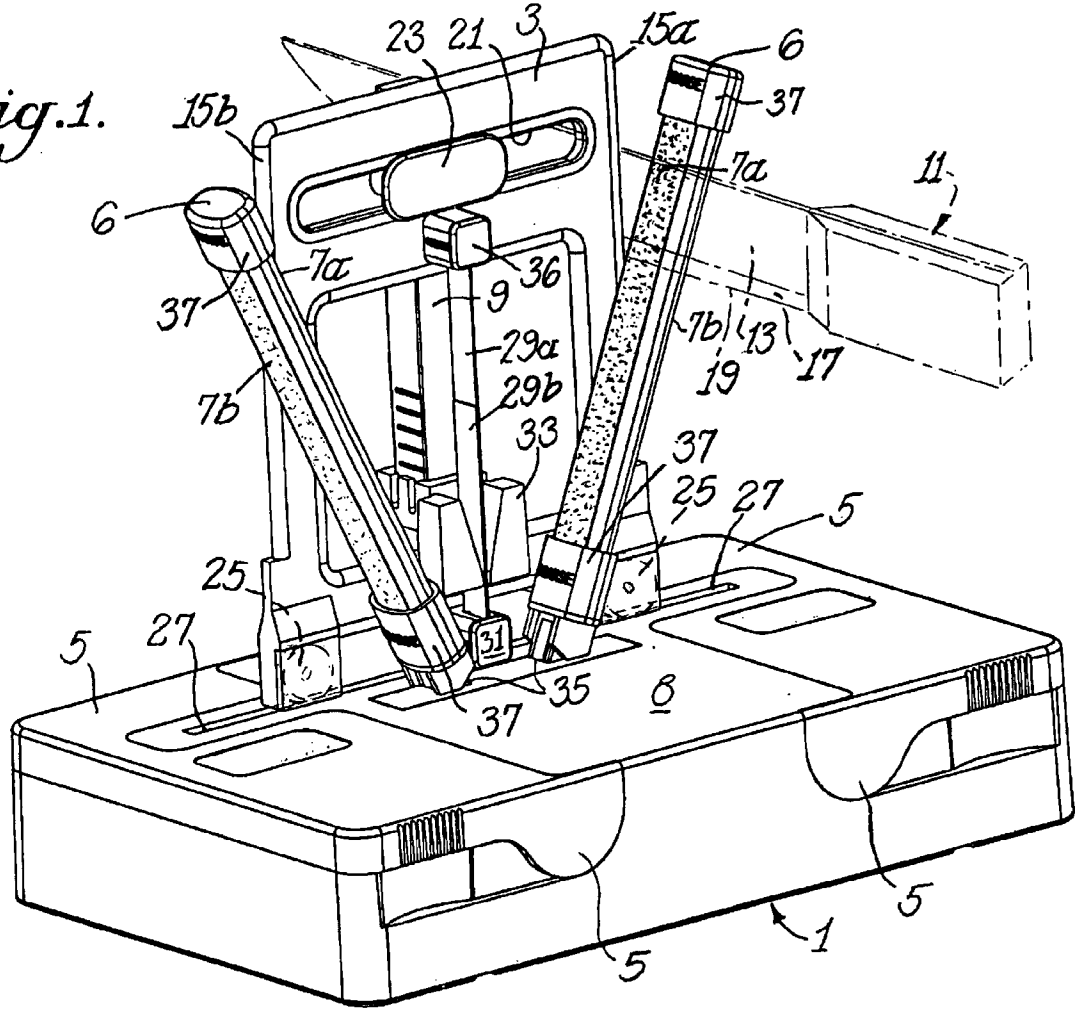
FIG. 1 is a perspective view of a portable manual knife sharpener in accordance with this invention.
Figure 2:
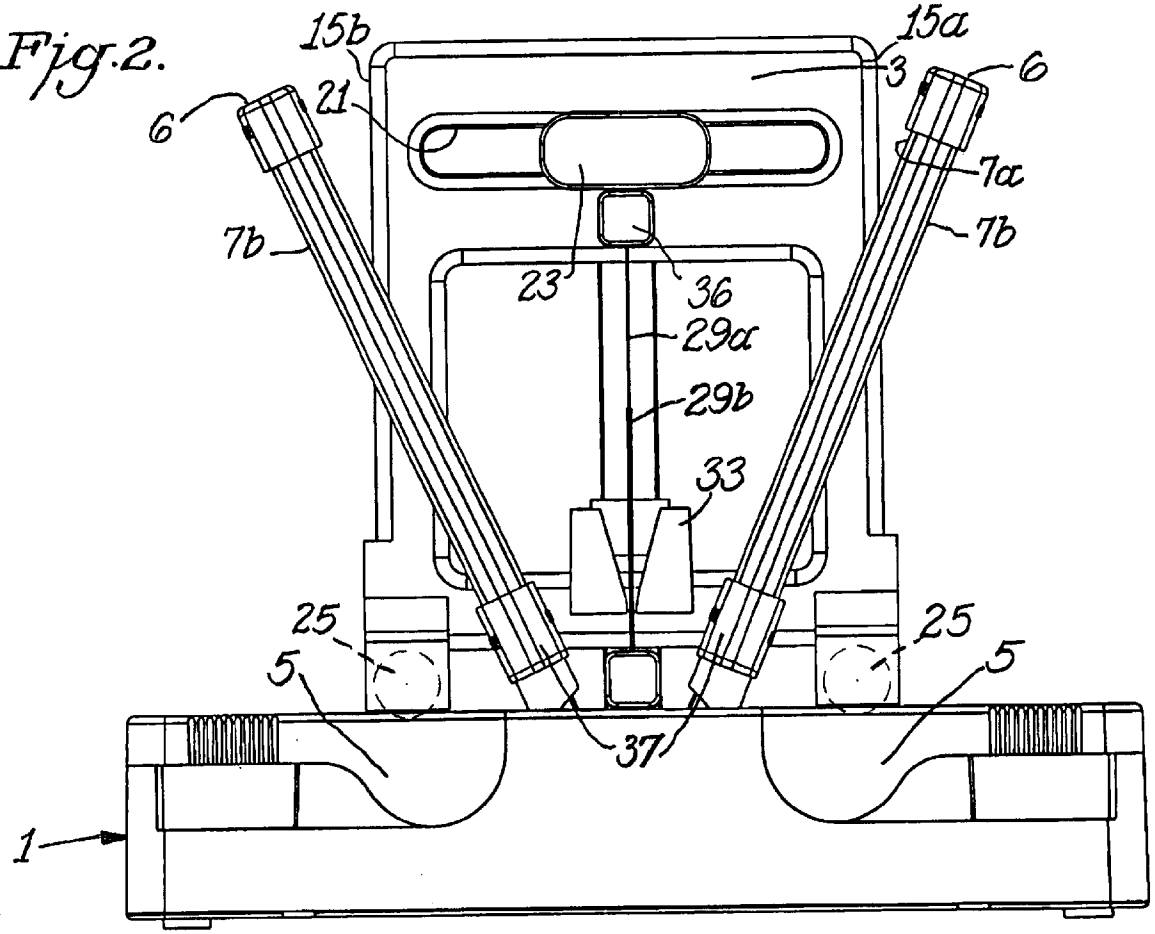
FIG. 2 is a front elevational view of the sharpener shown in FIG. 1.

A sharpener 1 that incorporates the novel knife guiding principle of this invention is illustrated in FIGS. 1 and 2. A supporting structure 8 serves both to support the active components of the sharpener and to provide storage space in a single compartment for those active components within its underside when the sharpener is not being actively used.

Each of two inclined and removable abrasive coated structures 6 are double sided and have abrasives or abrasive coatings on their mutually facing abrasive surfaces 7*a* and their opposite sides 7*b*. The abrasives can be solid materials such as alumina, or silica, for example. Alternatively the abrasives can be coatings of small abrasive particles of these or other materials including diamonds for example on metallic or other substrate materials. The abrasive coated structures 6 are designed to permit a coarse grit abrasive surface on one side such as on 7*a* and fine grit abrasive on the other side 7*b*.

Figure 8:
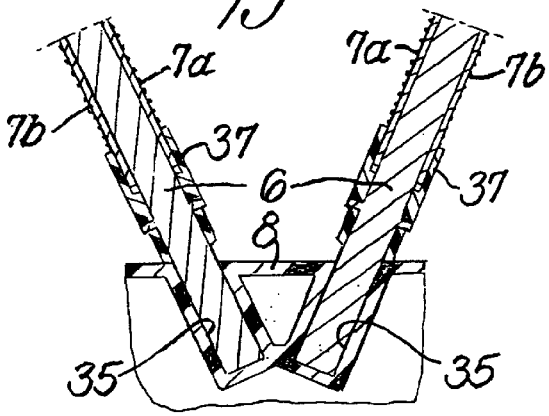
FIG. 8 is a cross sectional view in elevation showing the abrasive coated structures mounted in the sockets of the sharpener shown in FIGS. 1–7.

One facet along the knife edge being sharpened is guided so that the facet moves across one of the facing abrasive surfaces 7*a* (See FIG. 1). The lower end of the structures 6 are designed to snap firmly into position into sockets 35, shown in FIG. 8 provided in structure 8. The lower end of each of the structures 6 is uniquely designed to permit the abrasive coated structure 6 to be removed readily and rotated 180° to allow the blade to be sharpened on either one of the alternative abrasive surfaces, 7*a* or 7*b* located on the opposite sides of structure 6.

To sharpen the knife 11, the face 13 of blade 11 is held in intimate sliding contact with the linear guiding vertical feature 15*a* which is part of a displaceable guiding plate-like structure 3. The knife edge 19 is held nominally horizontal as one of its edge facets 17 is drawn across and in contact with the inclined abrasive surface 7*a*. The angular orientation of vertical feature 15*a* relative to the contacted inclined abrasive surface 7*a* is important in order to insure that the contacting edge facet 17, shown in FIG. 1 on right side of the edge is sharpened at the selected appropriate angle. The angular orientation of the abrasive surface 7*a* must also be precisely established and maintained.

The displaceable plate-like guiding structure 3 has two vertical guiding features 15*a* and 15*b*. With the knife 11 in position as shown in FIG. 1, its right hand facet is contacting the abrasive surface 7*a*. The knife can be removed from its position on the right and the other knife face 13 can be positioned in a similar position in the left hand "slot" against the other vertical guiding feature 15*b*. In that situation the edge is again held horizontal and then the left facet 17 will be in contact with the left inside abrasive surface 7*a* of the left abrasive coated structure 6.

The displaceable guiding plate-like structure 3 with its attached and integral guiding features 15*a* and 15*b* is mounted slidingly onto a supporting post 9. See FIGS. 1 and 4. The mounting post 9 fits snugly into a socket molded into the supporting structural 8. An elongated slot 21 in the displaceable plate-like guiding structure 3 is dimensioned to slide with close tolerance over bar 23 attached securely onto post 9. There are two roller type bearings 25 that roll in the slot 27 formed in the surface of supporting structure 8 to align the lower edge of the guiding structure 3 and to support in part the weight of the displaceable guiding structure 3. The slot 27, rollers 25, and the bar 23 are precisely aligned to allow the displaceable plate-like guiding structure 3 to be displaced with minimal friction. However a system of leaf springs 29*a* and 29*b* attached respectively to the plate-like structure 3 and to a spring mounting block 31 in turn attached to the supporting structure 8 provide a controlled resistive force when the plate-like structure 3 is displaced from its rest position. The spring constant of these springs 29*a* and 29*b* provide a force which must be exceeded by the user in order to displace the plate-like structure.

The user places the blade 11 alternately in the right and left "slots" defined by the vertex formed by the vertical guiding features 15*a* and 15*b* and the inclined abrasive sharpening surfaces 7*a*. The face 13 of the blade is pressed in intimate contact, for example with guiding feature 15*a* and lowered until the right vertical facet 17 of the blade makes contact with abrasive surface 7*a*. The blade is then pulled preferably in the direction toward the handle while keeping the face of the blade in intimate contact with the vertical feature 15*a* and keeping the right facet 17 in contact with the abrasive surface 7*a*. By pressing the left face 13 of the blade to the left the plate-like guiding structure will move to the left against the resisting force of the springs 29*a* and 29*b* and the blade face can simultaneously slide down while remaining in good contact with feature 15*a* to allow the facet 17 to slide down the abrasive surface 7*a*. By this method the abrasive sharpening action can be distributed along more of the abrasive surface so as to lengthen the active lifetime of the abrasive.

The spring constant or resistive force of the spring system 29*a* and 29*b* that must be overcome in order to displace the plate-like guiding structure 3 can be adjusted by means of an adjustable spring tensioner 33 mounted on vertical post 9. Spring 29*a* is a single leaf spring hanging downward from boss 36 attached to the plate-like structure 3. Spring 29*a* extends downward and is interleaved between a pair of leaf springs shown as 29*b*. Motion of the upper leaf 29*a* is restrained by the two spring leafs 29*b*, one on either side of spring 29*a*. As the spring tensioner 33 is raised up the post 9, it acts to effectively shorten the two leaf springs 29*b* and thereby to increase the force required to displace laterally spring 29*a* which is rigidly attached to boss 36.

As the spring tensioner is raised, the force required to displace the plate-like structure 3 is increased. As that force increases the force between the abrasive surface 7*a* and the right facet 17 is increased because the user instinctively and simultaneously pushes down harder on the knife 11 to maintain contact of the facet 17 with the abrasive at the same time that he presses harder to deflect the plate-like structure 3 to the left. The overall result is that the facet is pressed harder against the abrasive surface thus speeding the rate of metal removal from the facet.

If the knife to be sharpened is very dull or its facets are incorrectly angled, it is desirable to set the spring tensioner to its highest position and hence to increase the rate of sharpening. By lowering the tensioner after the geometry of the facet is well formed, the sharpening force will decrease and leave a smoother surface and an edge that is freer of larger edge imperfections.

The perfection of the edge can be further influenced by the grit size of the abrasive used. By sharpening first with a coarse grit, followed by a finer grit the sharpening process can be hastened and a better edge will be created. This sharpener makes it possible to easily change the grit size simply by removing the inclined abrasive coated structure and rotating that structure 180°. One side 7*a* can, for example be coated with a coarse abrasive and the other side 7*b* coated with a finer abrasive.

Figure 4:
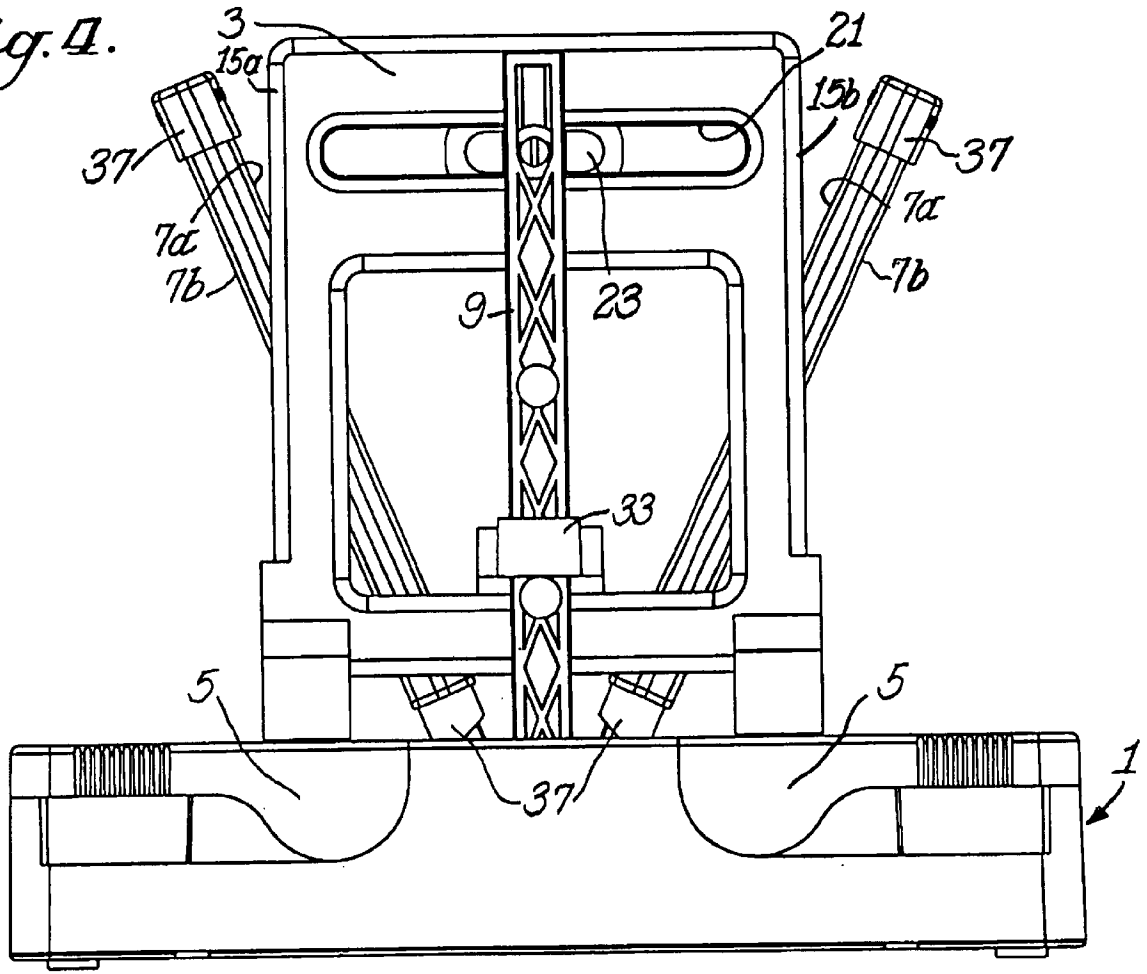
FIG. 4 is a rear elevational view of the sharpener shown in FIGS. 1–3.
Figure 5:
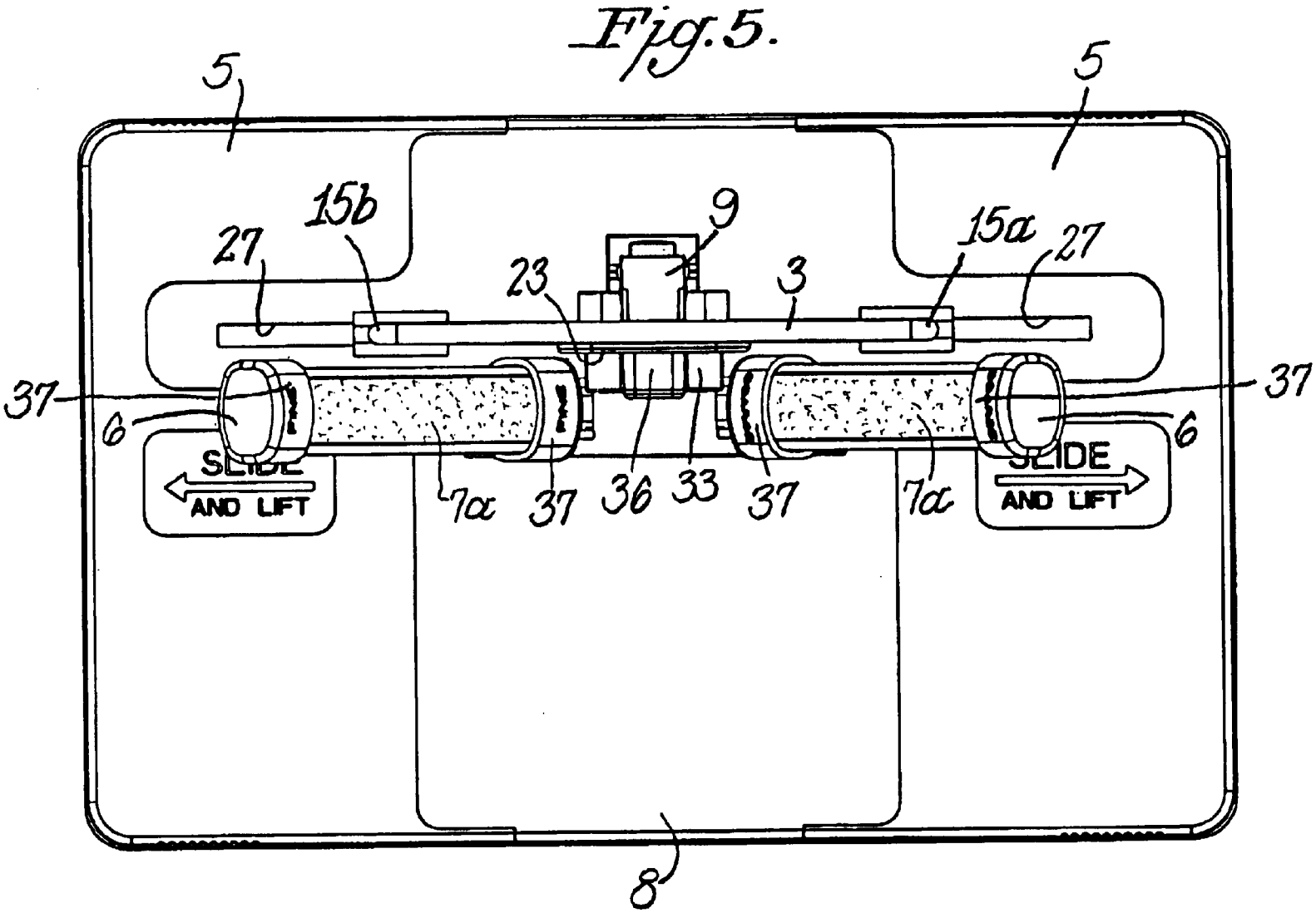
FIG. 5 is a top plan view of the sharpener shown in FIGS. 1–4.

This novel abrasive-coated structure 6 shown in FIGS. 1 and 4 are unique in that when they are each removed, rotated 180°, and reinserted into their respective sockets 35 (FIG. 8) the angular inclination of the active abrasive surface changes by a small, precisely predetermined angular amount A,—for example 2 to 3°. See FIG. 9. This novel feature makes it possible to create desirable double beveled facets (FIG. 10) by sharpening first the principle facets 17 at, for example 20°, and to then sharpen only the minor facets 17*a* immediately adjacent to the edge at, for example, 22°. By selecting a coarse grit at 20° to sharpen the principle facets 17, the time required to sharpen that area can be reduced. Then the user can remove the abrasive coated structure and rotate it 180° which will set the abrasive at 220 and a fine grit can be used on that side of the abrasive structure to create the finely honed small facets 17*a* immediately adjacent to the edge. This process will create an exceedingly sharp edge free of major imperfections. Even though the fine abrasive removes metal slower than a coarse grit does, the area to be abraded is relatively small and a very sharp edge can be honed quickly.

In order to maintain high accuracy of the sharpening angle, it is important to locate the displaceable knife guiding feature 15*a* close to the side of the abrasive coated structures 6. By locating the guiding feature as close as possible to the abrasive, the opportunity for an angular error resulting from the operator's handling of the knife is significantly reduced. Further, in order to sharpen each knife near its tip while maintaining good angular control it is important to locate the displaceable knife guiding feature 15*a* as close as practical to the abrasive surface, and not more than an inch of the abrasive surface.

Figure 3:
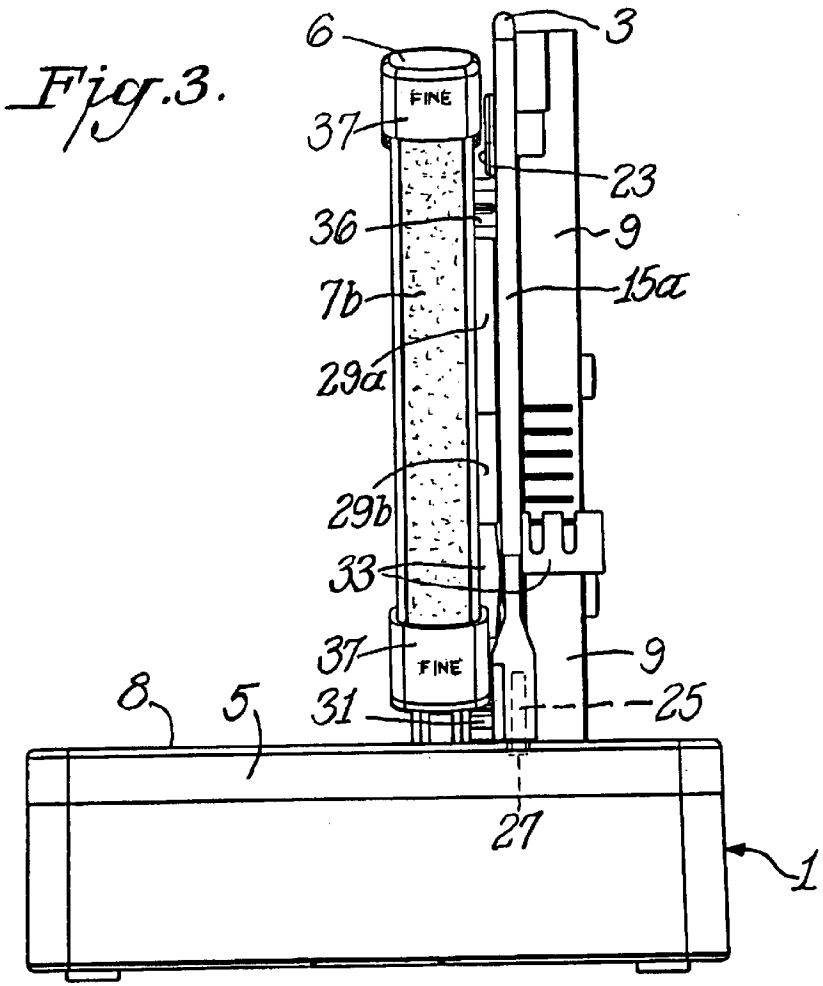
FIG. 3 is a side elevational view of the sharpener shown in FIGS. 1–2.

FIG. 3 shows inclined abrasive coated structure 6 immediately in front of the displaceable guiding plate-like structure 3 with knife 11 inserted in the "vertex" between guiding structure 15*a* and the abrasive surface 7*a*. The face 13 of knife 11 is in intimate sliding contact with guiding feature 15*a*. Knife 11 is pressed downward and to the left against the guiding structure 3 in order to maintain the right facet 17 in contact with the abrasive surface. That facet moves down the inclined abrasive surface as the knife is simultaneously drawn forward pulling that same facet forward over the abrasive. Consequently the facet simultaneously is moved down and forward across the abrasive and any abrasive particle will trace a line across the facet and diagonal to the edge. This type of abrasive motion across the facet creates a desirable microstructure along the edge and a very sharp edge. The abrasive coated structure inserts into a precisely fitting mounting socket 35 formed in the surface of supporting structure 8. The axis of the lower portion 4 of this structure is aligned at angle A (FIG. 9) relative to the axis of structure 6 and the abrasive pads. Typically angle A is about 1 to 1½° so that when the abrasive coated structure is withdrawn from its mounting socket, turned 180° and reinserted the inclination of the active abrasive surface will change 2–3°.

Figure 6:
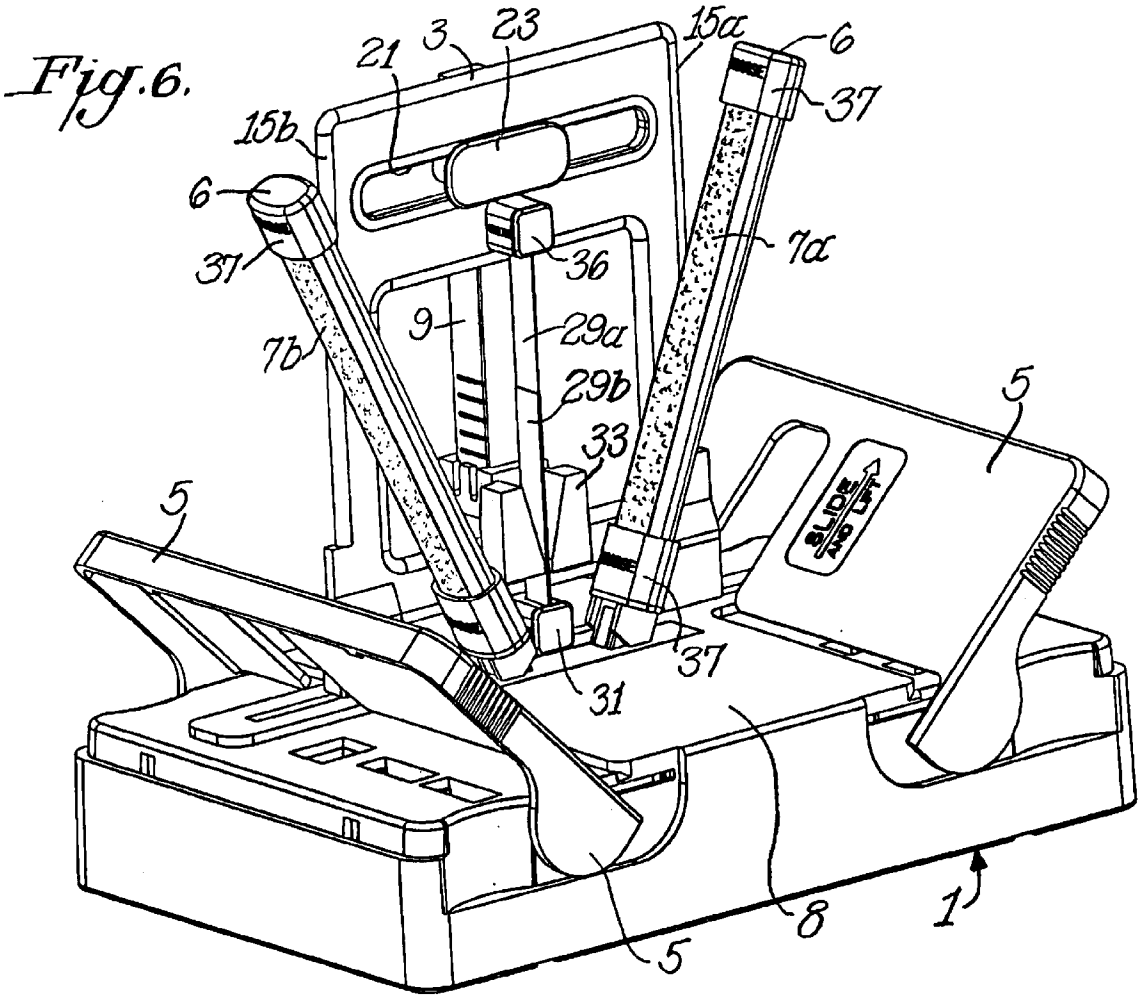
FIG. 6 is a perspective view of the sharpener shown in FIGS. 1–5 in a different mode of operation.
Figure 7:
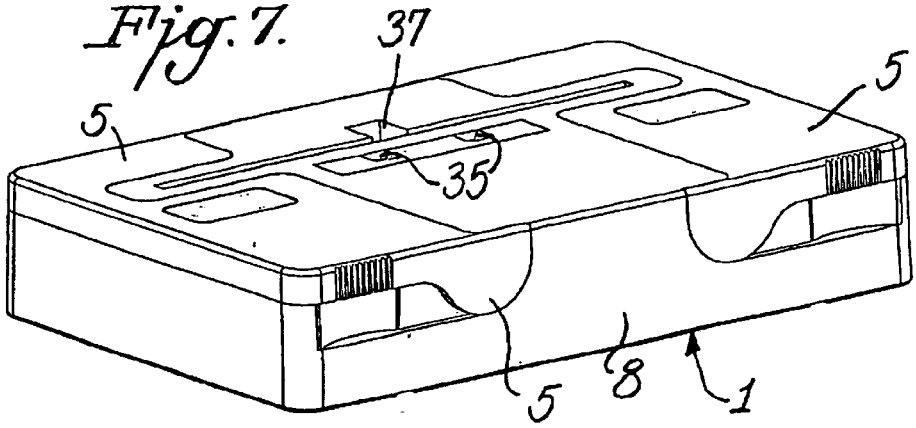
FIG. 7 is a perspective view of the supporting structure of the sharpener shown in FIGS. 1–6.

As shown in FIGS. 4 and 6 this novel sharpener includes provision for one or more hand guards 5 to protect the hand when holding the sharpener. Commonly a right handed person would steady the sharpener with his left hand and position and pull the knife with his right hand. In that event the left hand guard 5 could be raised as shown in FIG. 6. A left handed person would likely lift the right hand guard 5 and hold and pull the blade with his left hand. The hand guards when lifted are designed to snap into a positive holding position. In order to lift the guards they must first be pulled outwardly, then raised, and then slid forward to the positive holding position. The guards when lowered recess into the surface of the support structure.

Figure 9:
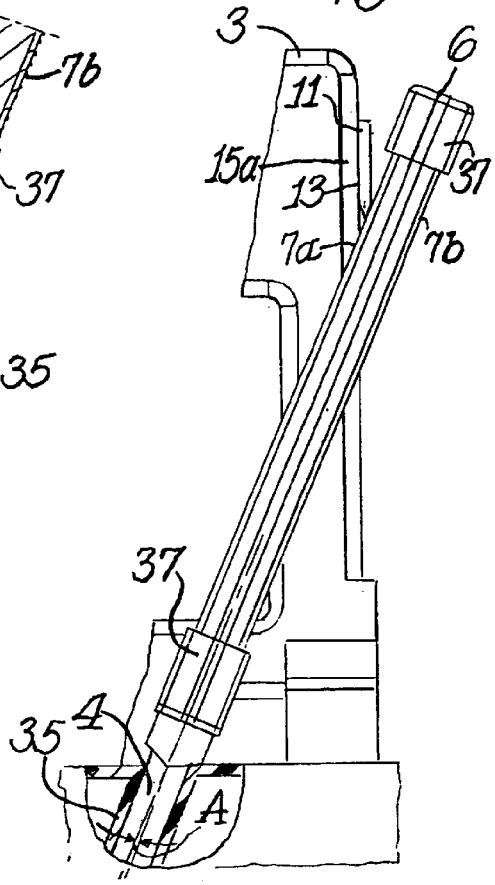
FIG. 9 is a side elevational view partially in section showing one of the abrasive coated structures of the sharpener shown in FIGS. 1–8.
Figure 10:
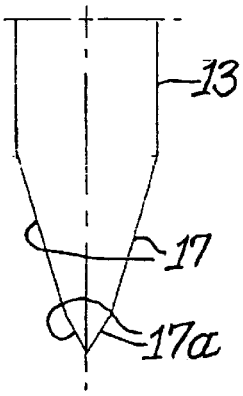
FIG. 10 is a side elevational view of a knife blade that would be sharpened by the sharpener of FIGS. 1–9.

The abrasive support structures 6 snap into recess sockets 35 FIGS. 8 and 9 into the surface of the sharpener support structure 8. The abrasive elements 7*a* and 7*b* shown in cross-section in FIG. 8 are in preferred design a chord section of a cylindrical surface in order to favor convenient contact with the knife facet even in the event of a small angular misalignment of the blade and to offer a larger abrasive surface. By contacting the facet with a curved surface in this way a slightly higher localized pressure against the abrasive is realized thus favoring more favorable abrading conditions for metal removal from the facet. The end caps 37, FIGS. 1 and 2 on the abrasive support structure 6 are designed to physically capture the curved sections of abrasive or abrasive coated members 7*a* and 7*b* and to permit their ready replacement. Solid abrasive members or abrasive coated structures with flat or curved abrasive surfaces can be employed. The cross-section of the abrasive coated structure 6 can be triangular or multi-surfaced to accommodate three or more different abrasive or abrasive coated elements designed to provide a greater variety of abrasive grit sizes, abrasive materials for conventional blades or special abrasive surface shapes to match unusual serrations of special blades. The geometry of the abrasive or abrasive coated surface can be rectangular, linear, cylindrical, elliptical, or any special geometry needed to match the geometry of the facet to be abraded.

Figure 11:
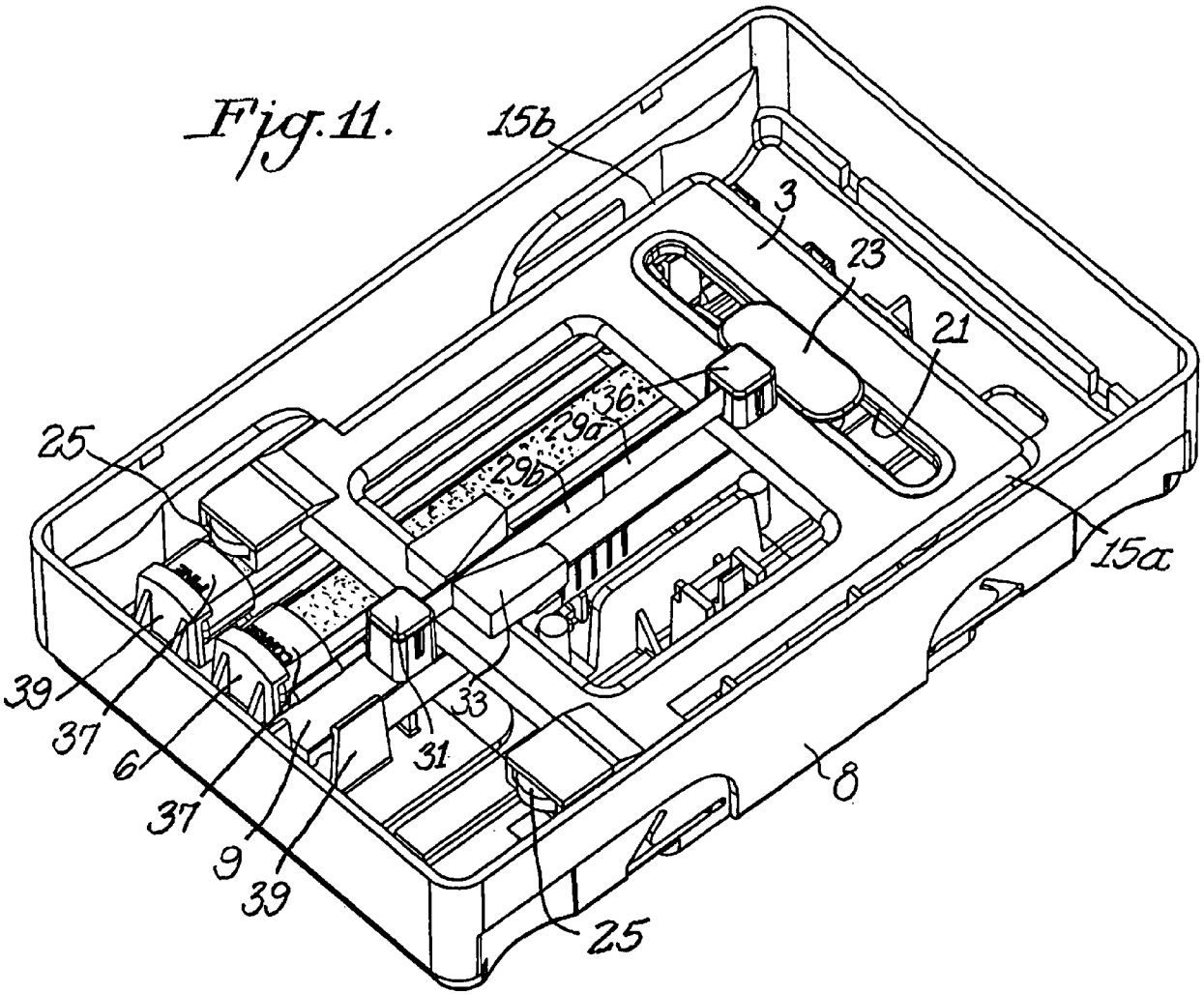
FIG. 11 is a bottom perspective view of the sharpener shown in FIGS. 1–9.

This unique sharpener is designed to allow all of the active sharpening elements to be stored within the single underside cavity of structure 8. See FIG. 11. The displaceable plate-like guiding structure 3 is attached to its supporting post 9 and is held into this underside cavity by a number of molded plastic spring snaps 39. The two inclined abrasive coated structures 6 likewise can be stored in the same cavity and held there securely by other spring snaps 39.

In summary this invention relates to a sharpener having a guiding feature on a guiding structure located near to the side of an abrasive surface so that the face of the blade can be disposed against the guide surface as the blade facet is moved across the abrasive surface to sharpen the blade. In the embodiment illustrated here the linear guide surface is movable in a direction perpendicular to its surface plane and at the same time the surface of the linear guide feature in all stages of displacement remains parallel to its initial plane.

As described herein when the knife blade 13 is lowered into the space between guide surface 15*a* and abrasive surface 7*a* and held with the face of the blade in intimate contact with guide surface 15*a* a force is created pushing laterally against surface guide 15*a*. This results in the face of the blade 13 being held in secure sliding contact with the guiding surface 15*a* while the blade is moved downwardly. One blade edge facet 17 remains in good contact with abrasive surface 7*a* and is accordingly reconfigured and sharpened. Importantly, as the blade face 13 moves along the guide, the blade displaces the guide structure 3. The plane of the guiding surface, however, in this example always remains vertical. Thus, the movement of the displaceable plate 3 is solely a lateral movement. The blade face 13 is always held in sliding contact against the guide surface 15*a* and its edge facet 17 is consequently consistently presented to the plane of the abrasive surface 7*a* at the same angle at the point of contact.

While this invention has been described with the abrasive surface being in a nominally vertical configuration, it is to be understood that the various embodiments of this invention described herein could be practiced when the entire mechanism is rotated through any angle including 90°. By rotating the entire mechanism the abrasive surface could be horizontal. The location of springs can be adjusted to optimize performance of the guide mechanism depending on its angular reorientation. Thus, in accordance with the invention it is not critical that the guide plane be in a nominally vertical configuration so long as the movement or displacement of the guide member remains in the same angular orientation with the abrasive surface whether completely vertical, completely horizontal or an intermediate angle without any rotation or pivoting of the guide surface during its displacement.

The surface of the linear guide surfaces 15*a* and 15*b* can be designed to minimize scratching of that face of the blade which is held against the face of the linear guide surface while the edge facet 17 is moved in contact with the abrasive surface 7*a*. Using a flocked coating or a polymer coating on the linear guide surface can minimize scratching. Rollers, can be used to form or constitute the linear guide surface. Such rollers will rotate as the knife face is moved linearly against their surface, thus minimizing or eliminating scratching of the face of the blade. The surface of the roller can, if desired, be plastic, a brush-like structure rubberized or flocked to minimize scratching.

Further to minimize the opportunity for scratching the face of the blade, it has proven useful to locate brushes adjacent to the guiding features 15*a* and 15*b*. The brushes should be located in the immediate vicinity of or attached adjacent to the guiding features in order that the face of the blade can be brushed clean of any metal or abrasive particles as the face of the blade during the sharpening cycle is brought into contact with the brush or brushes. It is also useful to combine a brush with rollers so that the brush contacts and cleans the roller of sharpening debris or abrasive particles as the roller turns.

In the described sharpener configuration, a magnetic material or structure can be aligned with the guide surface to provide an appropriate magnetic attraction of the face of the blade to the guide surface thereby assisting the operator maintain good contact of the blade face with the guide surface. The magnitude of the magnetic attraction should not be so large as to impede ready movement of the blade face in any direction along the guiding features.

The various mechanisms thus described herein are examples of structures that can be used to allow motion of the guiding structure perpendicular to the axis of that structure while insuring that the guide surface remains parallel to its prior orientation.

The guide structure shown herein is preferred. The invention, however, may also be practiced with other guide structure or using other features such as disclosed in application Ser. No. 10/023,190, all of the details of which are incorporated herein by reference thereto.

What is claimed is:

1. A sharpener for blades with an edge and at least one edge facet comprising a physical structure supporting at least one abrasive surface, a knife guiding plate displaceable in a direction perpendicular to its guide surface plane with an integral linear structural feature of said plate disposed toward one side of said abrasive surface, and said feature providing sliding contact with a face of the blade to establish the relative angle of the plane of the edge facet with the plane of said abrasive surface at the point of mutual contact as the facet is guided into contact with said abrasive surface.

2. A sharpener according to claim 1 where said displaceable guiding plate is displaceable in a direction nominally perpendicular to the axis of said linear structural feature as the blade face is moved slidingly or in rolling contact with said structural feature and the face remains parallel to the axis of said linear structural feature.

3. A sharpener according to claim 1 where said displaceable guiding plate is displaceable in a direction that when displaced maintains the axis of said linear structural feature parallel to the position of said axis before its displacement.

4. A sharpener according to claim 1 where said displaceable guiding plate is supported on said physical structure in part by roller bearings.

5. A sharpener according to claim 1 where said displaceable guiding plate is supported slidingly onto a vertical post mounted onto said physical structure and said displaceable guiding plate has attached rollers that support at least a portion of the weight of said plate as said rollers rest and ride on said physical structure.

6. A sharpener according to claim 1 wherein said displaceable guide plate is located laterally to the side of said abrasive surface.

7. A sharpener for blades with a cutting edge and at least one edge facet, comprising a physical structure to which is attached at least one extended abrasive surface and a knife guiding plate displaceable in a direction perpendicular to its guide surface plane mounted adjacent to the side of the face of said abrasive surface to orient the blade and maintain the angular relationship of the edge facet with the plane of said abrasive element as said blade is moved into contact with different areas of said extended abrasive surface.

8. A sharpener according to claim 7 where a brush structure is mounted on or adjacent to said displaceable guiding plate and in a manner to contact surfaces of the blade while it is being sharpened and remove particulate abrasive and metal debris from the blade.

9. A sharpener according to claim 7 where the surface contour of said extended abrasive surface is of a shape selected from the group consisting of planar, curved, irregularly shaped and multifaceted.

10. A sharpener according to claim 7 where a roller is used as the guiding feature for the blade and a brush is positioned in contact with surface of said roller to remove particulate abrasive and other debris from said blade.

11. A sharpener for blades with an edge and at least one edge facet, comprising a physical structure to which is attached at least one extended abrasive surface and at least one knife guiding plate displaceable in a direction perpendicular to its guide surface plane with an integral structure feature that provides linear or planar sliding or rolling contact with the face of the blade at a location on the face of said blade where the edge facet immediately adjacent to the blade face at said location is not simultaneously in contact with said abrasive surface to orient the blade and maintain the angular relationship of said edge facet with the plane of said extended abrasive surface.

12. A sharpener according to claim 11 where at least one spring is attached to said displaceable knife guiding plate and to said physical structure to offer resistance to displacement of said knife guiding plate from a rest position and to provide a restoring force to return said plate to a rest position.

13. A sharpener according to claim 12 where the spring force to displace or restore the displaceable knife guiding plate to its rest position is adjustable.

14. A sharpener for blades with an edge and at least one edge facet, comprising a physical structure supporting at least one extended abrasive surface member and supporting a displaceable knife guiding plate attached slidingly to a detachable post mounted to said physical structure, and said guiding plate has attached bearings that support at least a portion of the weight of said displaceable plate as said bearings bear on the surface of said physical structure.

15. The sharpener of claim 14 where at least one spring is attached to said displaceable knife guiding plate and to said post to offer resistance to displacement of said knife guiding plate from a rest position and to provide a restoring force to return said plate to a rest position.

16. The sharpener of claim 15 where said spring is a leaf type spring.

17. The sharpener of claim 14 where said physical structure includes an integral compartment for storage of said displaceable knife guiding plate attached to said detachable mounting post and at least one said extended abrasive surface member.

18. The sharpener of claim 1 including at least one guard for a hand holding or steadying said structure that can, while the blade is being sharpened and without physically interfering with said abrasive surface member be positioned either in a down position nominally against the surface of said physical structure or raised to protect said hand.

19. The sharpener of claim 1 where said at least one abrasive surfaces comprises a pair of extended abrasive members, said physical structure comprising a single box-like enclosure with a single removable bottom cover for the entire enclosure which can be removed to allow the pair of said abrasive members to be stored together in said single enclosure.

20. A sharpener according to claim 19, where said enclosure is sufficiently large to store said guiding plate together with said abrasive members in said single enclosure.

21. A sharpener according to claim 19 comprising at least two hinged hand guards mounted on and recessed when in stored position into the surface of said box-like enclosure, where said guards may remain recessed in said stored position as said extended abrasive members are mounted onto said physical structure for sharpening the blades.

22. A sharpener for blades with a cutting edge and at least one edge facet comprising a physical structure supporting at least one extended abrasive surfaced structure by a socket in said physical structure, a knife guide on said physical structure, said abrasive surfaced structure having two separate and distinct sides each of which has an abrasive surface, said knife guide being located toward one of said sides whereby a knife blade may be disposed against said knife guide and be in contact with said abrasive surface of said one side, said abrasive surfaced structure being detachably mounted in said socket in such a manner to permit said abrasive surfaced structure to be withdrawn from said socket and then rotated and reinserted into said socket to dispose the other of said distinct sides toward said knife guide, and each of said distinct sides forming a different angle with respect to said knife guide to chance the angular inclination in accordance with which of said distinct sides is disposed toward said knife guide.

23. A sharpener according to claim 22 where each of said distinct sides has an abrasive surface of different abrasive grit.

* * * * *